United States Patent [19]

Belcher

[11] Patent Number: 4,962,809

[45] Date of Patent: Oct. 16, 1990

[54] HEAT EXCHANGER

[75] Inventor: Bryan L. Belcher, Leamington SPA, England

[73] Assignee: Rolls-Royce plc, London, England

[21] Appl. No.: 493,727

[22] Filed: Mar. 15, 1990

[30] Foreign Application Priority Data

Apr. 21, 1989 [GB] United Kingdom ..... 8909066

[51] Int. Cl.[5] ..... F28F 27/02

[52] U.S. Cl. ..... 165/101; 165/96; 165/97; 165/100

[58] Field of Search ..... 165/96, 97, 100, 101

[56] References Cited

U.S. PATENT DOCUMENTS

| | | | |
|---|---|---|---|
| 2,487,484 | 11/1949 | Simpelaar | 165/97 |
| 3,520,354 | 7/1970 | Lawrence | 165/97 |
| 4,062,189 | 12/1977 | Mager et al. | 165/97 |
| 4,582,765 | 4/1986 | Kothmann | 165/97 |
| 4,699,676 | 10/1987 | Held | 165/97 |
| 4,798,242 | 1/1989 | Kito et al. | 165/101 |

FOREIGN PATENT DOCUMENTS

| | | | |
|---|---|---|---|
| 521265 | 3/1931 | Fed. Rep. of Germany | 165/97 |
| 745962 | 12/1943 | Fed. Rep. of Germany | 165/97 |
| 2305707 | 10/1976 | France | 165/97 |
| 608431 | 9/1960 | Italy | 165/97 |
| 641153 | 8/1950 | United Kingdom | 165/97 |

*Primary Examiner*—John Rivell
*Assistant Examiner*—L. R. Leo
*Attorney, Agent, or Firm*—Cushman, Darby & Cushman

[57] ABSTRACT

A heat exchanger suitable for placing air and cold hydrogen in heat exchanger relationship with each other comprises two concentric annular arrays of header tubes, all the header tubes in the radially outer array being in flow communication with a first manifold while half of the header tubes in the radially inner array are in flow communication with a second manifold and the remainder are in flow communication with a third manifold. Heat exchange pipes interconnect the various header tubes and air flows over those pipes. Various valves and pipes are provided and are operable to ensure that the heat exchanger functions in two modes of operation; a first in which cold hydrogen flows through all the heat exchange pipes in a single direction and a second in which the cold hydrogen flows through alternate heat exchange pipes in the opposite direction.

8 Claims, 3 Drawing Sheets

HEAT EXCHANGER

This invention relates to heat exchangers and in particular to heat exchangers which are intended for use in aerospace vehicles.

Heat exchangers which are intended for use in aerospace vehicles must, necessarily, be compact, lightweight and efficient, especially if the vehicle concerned has a requirement for a large capacity heat exchanger. For example, aerospace vehicles which are intended to operate in the atmosphere and transatmospherically may be provided with engines which are capable of operation in both environments. Such an engine is described in UK patent application No. 8430157 in which heat exchangers through which fuel, which has been cryogenically stored, is passed, are suitable positioned to be in heat exchange relationship with air which is subsequently directed into the compressor of the engine. A heat exchanger intended for use in such an engine is described in UK patent application No. 8719446.

The major problem with heat exchangers of this type is that when the engine to which the heat exchanger has been fitted operates in air which has a high moisture content, water vapor in the air condenses on the heat exchanger matrix and freezes to form frost As frost builds up on the heat exchanger matrix, there is progressive blocking of the matrix until eventually an insufficient quantity of air is able to pass through the heat exchanger to sustain the operation of the engine One way of achieving an effective heat exchange relationship between the air and fuel is to provide a heat exchanger in which the air and fuel are subjected to a contra-flow heat exchange relationship. Thus the air and fuel flow in generally opposite directions. Such a heat exchange relationship is highly desirable as far as efficient engine operation is concerned at high altitude where moisture levels are low. However at low altitude where moisture levels are high, frost builds up towards the downstream end of the heat exchanger (with respect to the flow of air therethrough). This is because at the downstream end, the cryogenic fuel and air are at their lowest temperatures. At the upstream end of the heat exchanger, the air is at its highest temperature and the cryogenic fuel, which at this point has passed through the majority of the heat exchanger and has been heated up by the air flow, is also at its highest temperature.

An alternative way of achieving heat exchange is to arrange that the air and cryogenic fuel flow in the same direction i.e. to ensure that they are in parallel flow heat exchange relationship. This results in a more even frost deposition within the heat exchanger so that the rapid frost build up at the downstream end of the heat exchanger associated with contra-flow heat exchange is avoided. However the problem of progressive blocking of the heat exchanger matrix by frost build-up still exists.

It is an object of the present invention to provide a heat exchanger which has improved resistance to the build-up of frost on its matrix.

According to the present invention, a heat exchanger suitable for placing first and second fluids in heat exchange relationship with each other comprises two arrays of header tubes, which arrays are spaced apart from each other, each header tube in one of said arrays being in flow communication with a respective header tube in the other of said arrays via a plurality of heat exchange tubes, said heat exchange tubes being so configured and disposed as to be other than normal to the operational flow of the first of said fluids thereover, the header tubes of one of said arrays being in flow communication with a first manifold, some of the header tubes in the other of said arrays being in flow communication with a second manifold and the remainder of the header tubes in said other array being in flow communication with a third manifold, pipe and valve means being provided and so arranged that in a first mode of operation said second fluid is supplied to said first manifold only, so as to flow to both of said second and third manifolds via said header and heat exchange pipes and be subsequently exhausted from said second and third manifolds, and in a second mode of operation said second fluid is supplied to said third manifold only, so that said second fluid flows from said third manifold to said second manifold via said first manifold and said header and heat exchange pipes and is subsequently exhausted from said second manifold so that said second fluid is in operation sequentially placed in parallel flow and then contra-flow heat exchange relationship with said second fluid by its passage through said heat exchange pipes.

to a further aspect of the present invention, a heat exchanger suitable for placing first and second fluids in heat exchange relationship with each other comprises a plurality of heat exchanger tubes through which the second of said fluids operationally flows and over which the first of said fluids operationally flows, said heat exchanger being arranged such that the second of said fluids is, in operation sequentially placed in parallel flow and then contra-flow heat exchange relationship with the first of said fluids The invention will now be described, by way of example, with reference to the accompanying drawings in which:

Figure 1:
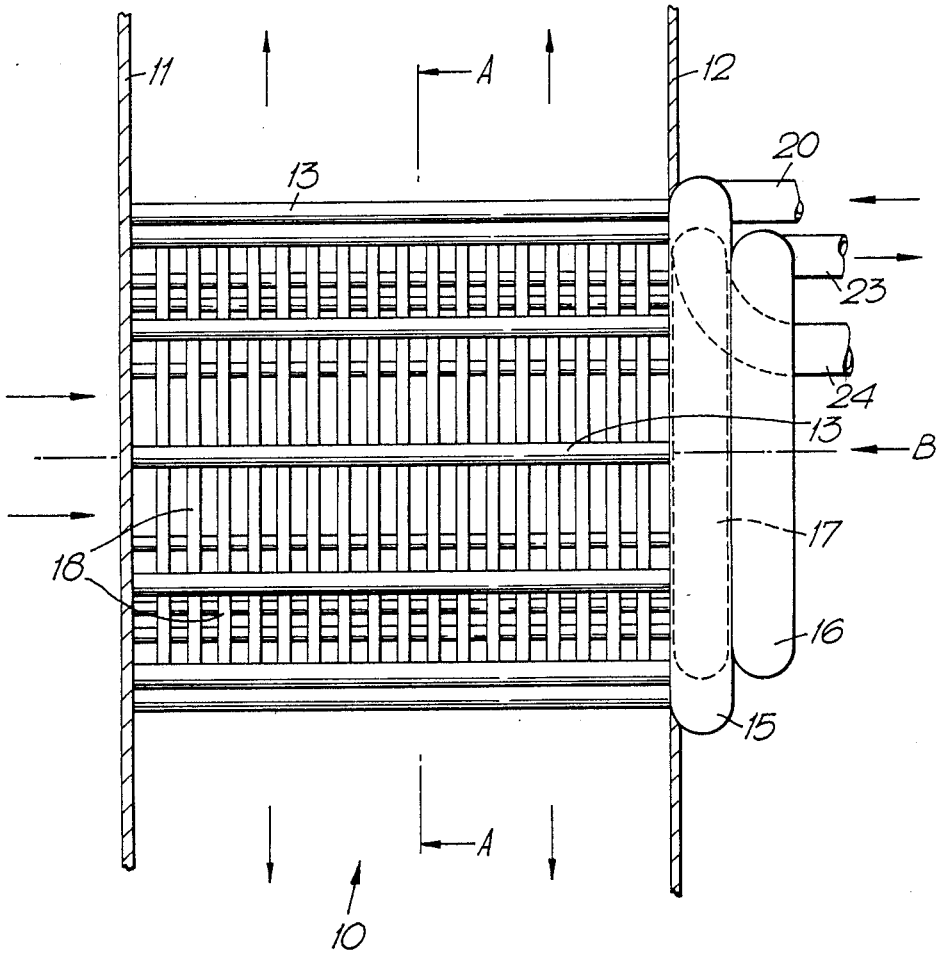
FIG. 1 is a side view of a heat exchanger in accordance with the present invention.
Figure 2:
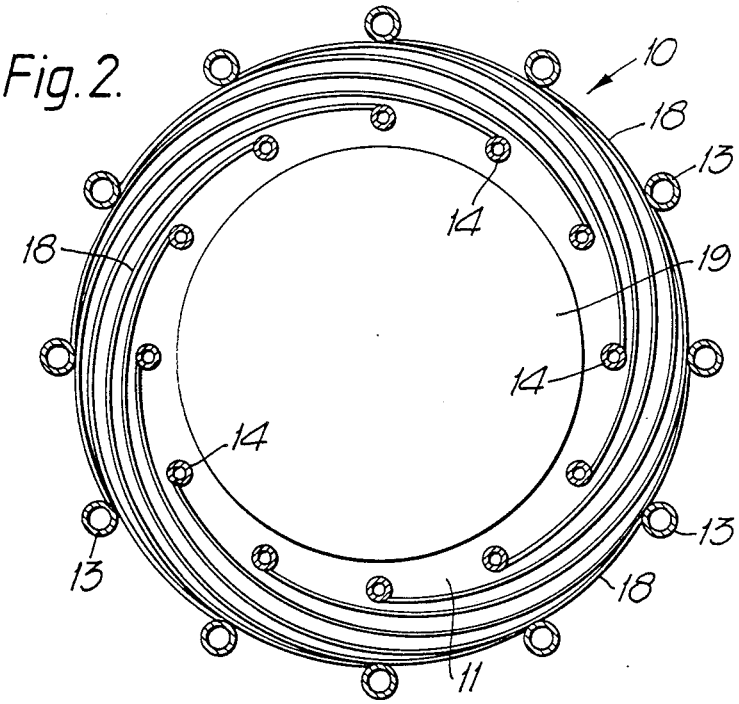
FIG. 2 is a view on section line A-A of FIG. 1.

With reference to FIGS. 1 and 2, a heat exchanger generally indicated at 10 comprises two support plates 11 and 12 between which are mounted two concentric annular arrays of header tubes 13 and 14. One annular array of header tubes 13 is located radially outwardly of the other 14 and all of the header tubes 13 and 14 are so disposed as to be parallel with each other.

All of the header tubes 13 in the radially outer annular array are in flow communication with a first annular manifold 15 which is located on the support plate 12. Alternate header tubes 14 in the radially inner array are in flow communication with a second annular manifold 16 which is located adjacent the first annular manifold 15. The remaining header tubes 14 in the radially inner array are in flow communication with a third annular manifold 17 which can be seen in interrupted lines in FIG. 1 and which is located radially inwardly of the first annular manifold 15. All of the first, second and third annular manifolds 15,16 and 17 are coaxial with each other and with the annular arrays of header tubes 13 and 14.

Each of the header tubes 13 in the radially outer annular array is in flow communication with a respective header tube 14 in the radially inner array via a plurality of heat exchanger tubes 18. Each heat exchanger tube 18, as can be most clearly seen in FIG. 2, extends in a generally circumferential direction and curves in a radially inward direction. In order that an adequate number of heat exchanger tubes 18 may be interposed between the annular arrays of header tubes 13 and 14, each heat exchanger tube 18 extends between header tubes 13 and 14 which are offset by some 150° from each other It will be appreciated however that the amount of angular off-set between each header tube 13 in the radially outer annular array and the corresponding header tube 14 in the radially inner array is a matter of choice depending upon the required performance of the heat exchanger 10.

In the operation of the heat exchanger 10, air is directed through an aperture 19 in the support plate into the region bounded by the radially inner array of header tubes 14. The air then flows through the heat exchanger 10 in a radially outward direction over the heat exchange tubes 18 to exhaust between the support plates 11 and 12 and radially outwardly of the radially outer array of header tubes 13. The heat exchange tubes 18 carry a flow of a gas which has been cryogenically stored, such as low temperature gaseous hydrogen which is to be placed in heat exchange relationship with the flow of air. Since the heat exchange tubes 18 curve radially inward, the direction of the air flow over them is other than normal to the direction of flow of hydrogen through them. Consequently depending upon the direction of flow of cold hydrogen through the heat exchange tubes 18, the air and cold hydrogen are either in a contra-flow heat exchange relationship or in a parallel flow heat exchange relationship.

Figure 3:
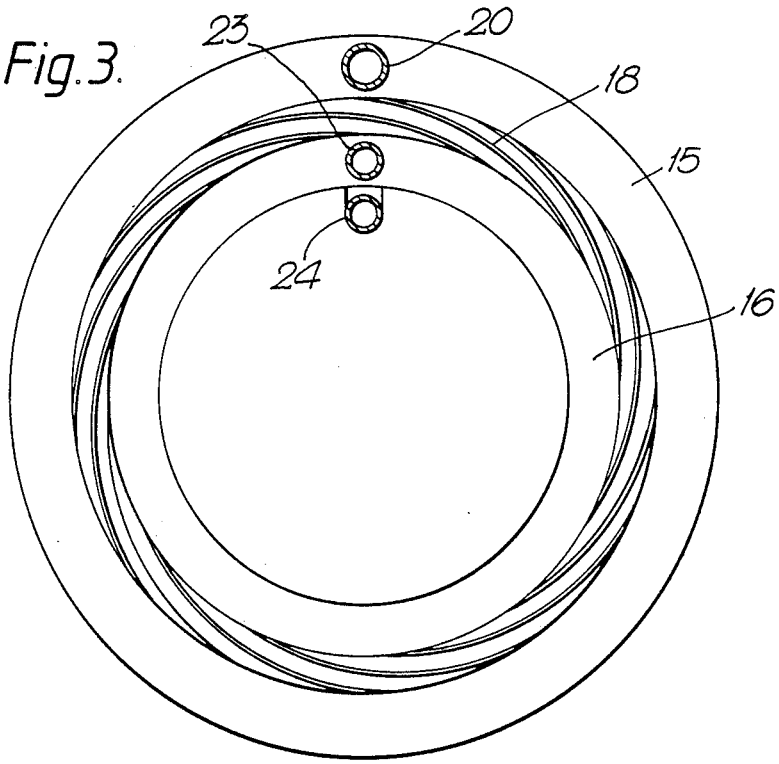
FIG. 3 is a view on arrow B of FIG. 1.
Figure 4:
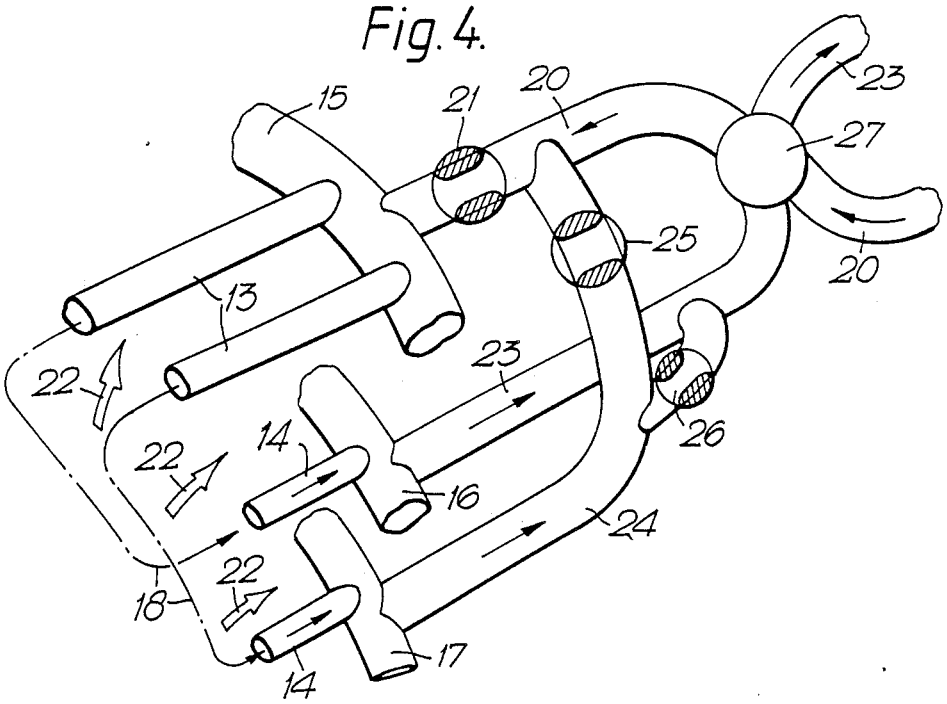
FIG. 4 is a diagrammatic view of a portion of the heat exchanger shown in FIG. 1 showing the directions of fluid flow therein in a first mode of operation.
Figure 5:
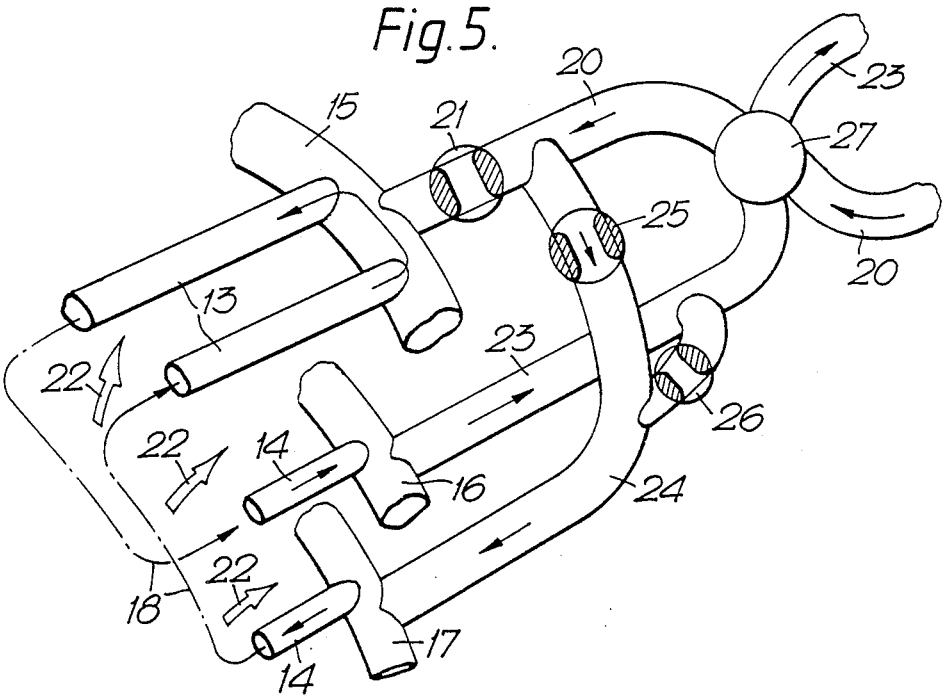
FIG. 5 is a further diagrammatic view of a portion of the heat exchanger shown in FIG. 1 showing the directions of fluid flow therein in a second mode of operation.

The manner in which cold hydrogen is directed to and from the heat exchange tubes 18 can be seen more clearly if reference is now made to FIGS. 3,4 and 5. In a first mode of operation of the heat exchanger 10, cold hydrogen is directed into the first manifold 15 through a supply pipe 20. It then flows past through an on/off valve 21, which in this mode of operation is fixed in the "on" position so as to permit the cold hydrogen flow therethrough, and into the first manifold 15. The cold hydrogen then flows along the header tubes 13 and into the heat exchange tubes 18 where it is placed in contra-flow heat exchange relationship with air flowing in the general direction indicated by the arrows 22. Such a contra-flow heat exchange relationship is very efficient and as such is the desired mode of operation if the air passing over the heat exchange tubes is dry.

From the heat exchange tubes 18, the cold hydrogen flows into the header tubes 14 in the radially inner array and into the second and third manifolds 16 and 17. The second manifold 16 is provided with an exhaust pipe 23 through which the cold hydrogen is exhausted from the heat exchanger 10. The third manifold 17 is provided with a bifurcated pipe 24 which interconnects the third manifold 17 with both the cold hydrogen supply pipe 20 upstream of the valve 21 and the liquid hydrogen exhaust pipe 23. The portion of the pipe 24 which interconnects with the supply pipe 20 is provided with an on/off valve 25 which in this first mode of operation is fixed in the "off" position so as to prevent the flow of cold hydrogen therethrough. The portion of the pipe 24 which interconnects with the exhaust pipe 23 is provided with an on/off valve 26 which in this first mode of operation is fixed in the "on" position so as to permit the flow of cold hydrogen therethrough. Thus cold hydrogen exhausted from the third manifold 17 is directed into the exhaust pipe 23.

If the air flowing over the heat exchange pipes 18 is moist i.e. has a high water vapor content, the low temperature of the cold hydrogen within the heat exchange pipes 18 causes at least some of that water vapor to condense on the heat exchange pipes 18 and freeze to produce an adherent layer of frost thereon. There is thus a progressive build-up of frost on the heat exchange pipes 18 which in turn results in a progressive reduction in the effectiveness of the operation of the heat exchanger 10.

In order to ensure that the heat exchanger 10 can continue to function effectively when the incoming air flow carries sufficient water vapor to result in problems associated with the frosting of the heat exchange tubes 18, the valves 21,25 and 26 are actuated in order to cause the heat exchanger 10 to operate in a second mode of operation. Specifically, the valve 21 in the cold hydrogen supply pipe is moved to the "off" position in order to prevent the supply of cold hydrogen from the supply pipe to the first manifold 15. The valve 25 is then moved to the "on" position so as to cause cold hydrogen to flow through the pipe 24 and into the third manifold 17. Valve 26 is moved to the "off" position in order to prevent the flow of cold hydrogen from the pipe 24 into the exhaust pipe 23.

The cold hydrogen flows into the header pipes 14 in the radially inner array which are in flow communication with the third manifold 17 and through the heat exchange pipes 18 connected thereto into alternate of the header pipes 13 in the radially outer array thereof. The cold hydrogen then flows through the alternate header pipes 13 and into the first manifold 15 from where it flows into the remainder of the header pipes 13 i.e. those which are not linked by the heat exchange pipes 18 with the header pipes 14 attached to the third manifold 17.

The cold hydrogen then flows from the header pipes 13 to the header pipes 14 in the radially inner array thereof which are in flow communication with the second manifold 16 via the relevant heat exchange pipes 18. The cold hydrogen flows into the second manifold 16 and is subsequently exhausted therefrom through the exhaust pipe 23.

It will be seen therefore that in the second mode of operation of the heat exchanger 10, cold hydrogen flows through half of the heat exchange pipes 18 in a radially outward direction while the remainder flows in a radially inward direction. Thus while half of the heat exchange pipes 18 place the cold hydrogen flowing therethrough in parallel heat exchange relationship with the air operationally flowing over them, the remainder place the cold hydrogen flowing therethrough in contra-flow heat exchange relationship with that air flow. Those heat exchange pipes 18 which contain cold hydrogen flowing in parallel heat exchange relationship with the air flow are subject to frosting. Thus as warm moisture laden air enters the upstream portion of the heat exchanger (with respect to the direction of air flow therethrough), it is placed in heat exchange relationship with hydrogen which is at its coldest temperature. As the air proceeds to flow through the heat exchanger, the air temperature progressively falls and the hydrogen temperature progressively increases. The effect of this is a substantially even deposition of frost on the heat exchanger pipes 18 which carry hydrogen in parallel heat exchange relationship with the airflow.

The remaining heat exchange pipes 18 which contain cold hydrogen flowing in contra-flow heat exchange relationship with the air flow are not, however subject to any substantial degree of frosting. Thus in the contra-flow situation, hydrogen at its lowest temperature enters the heat exchanger at its downstream end (with respect to the direction of air flow therethrough). However the hydrogen has already been placed in parallel flow heat exchange relation with the air flow by being passed through the other heat exchange pipes 18 and has therefore had its temperature raised. This being so the likelihood of frost formation on the heat exchange pipes 18 through which the hydrogen flows in contra-flow heat exchange relationship with the air flow is considerably reduced. Consequently, little or no frost is formed on the heat exchange pipes 18 containing hydrogen flowing in contra-flow relationship with the air flow.

It will be seen therefore that effectively only half of the heat exchange pipes 18 are subject to frosting and that therefore the heat exchanger 10 can continue to function in conditions which would otherwise result in it ceasing to function as a result of its blockage by the build of frost within its matrix.

Although operation of the heat exchanger 10 in the second mode of operation may be effective in ensuring a lesser accretion of frost on the heat exchange tubes 18, there may be circumstances in which an accretion of frost on only alternate heat exchange tubes 18 is unacceptable. Under such circumstances, the heat exchanger 10 may be operated in a third mode in which the flows through the inlet and exhaust pipes 20 and 23 are periodically reversed while maintaining the valves 21,25 and 26 in the positions adopted for the second mode of operation. This is achieved by the use of a simple cross-over valve 27. The effect of reversing the cold hydrogen flows through the supply and exhaust pipes 20 and 23 is to cause a corresponding reversal of the flow of cold hydrogen through the heat exchange pipes 18. Thus those heat exchange pipes 18 which previously provided contra-flow heat exchange now provide parallel flow heat exchange and vice versa. The effect of this is that those heat exchange pipes 18 which previously suffered frost accretion as a result of parallel heat exchange are subject to contra-flow heat exchange with a result that at least some of the frost on the pipes 18 partially melts and is shed from them. Consequently by periodically reversing the flows in the supply and exhaust pipes 20 and 23, the accretion of frost on the heat exchange tubes 18 can be maintained at acceptable levels.

Although the present invention has been described with reference to a heat exchanger 10 having header tubes 13 and 14 which are arranged in annular arrays, it will be appreciated that they could be arranged in different ways. Thus for instance the header tubes 13 and 14 could be arranged in linear banks which are spaced apart from each other.

I claim:

1. A heat exchanger suitable for placing first and second fluids in heat exchange relationship with each other comprising two arrays of header tubes, which arrays are spaced apart from each other, a plurality of heat exchange tubes each header tube in one of said arrays being in flow communication with a respective header tube in the other of said arrays via said plurality of heat exchange tubes, said heat exchange tubes being so configured and disposed as to be other than normal to the operational flow of the first of said fluids thereover, the header tubes of one of said arrays being in flow communication with a first manifold, some of the header tubes in the other of said arrays being in flow communication with a second manifold and the remainder of the header tubes in said other array being in flow communication with a third manifold, pipe and valve means being provided and so arranged that in a first mode of operation said second fluid is supplied to said first manifold only, so as to flow to both of said second and third manifolds via said header and heat exchange pipes and be subsequently exhausted from said second and third manifolds, and in a second mode of operation said second fluid is supplied to said third manifold only, so that said second fluid flows from said third manifold to said second manifold via said first manifold and said header and heat exchange pipes and is subsequently exhausted from said second manifold so that said second fluid is in operation sequentially placed in parallel flow and then contra-flow heat exchange relationship with said second fluid by its passage through said heat exchange pipes.

2. A heat exchanger as claimed in claim 1 wherein said heat exchanger is operable in a third mode of operation in which said pipe and valve means are so arranged for said second mode of operation and in which said second fluid is supplied to said second manifold and is subsequently exhausted from said third manifold.

3. A heat exchanger as claimed in claim 1 wherein alternate of said heat exchange tubes provide flow communication between said header tubes in flow communication with said first manifold and said header tubes in flow communication with said second manifold, the remainder of said heat exchange tubes providing flow communication between said header tubes in flow communication with said first manifold and said header tubes in flow communication with said third manifold.

4. A heat exchanger as claimed in claim 1 wherein said two arrays of header tubes are annular and concentric, the header tubes being parallel to the axis of the arrays.

5. A heat exchanger as claimed in claim 4 wherein each of said heat exchange tubes is curved.

6. A heat exchanger as claimed in claim 4 wherein said first of said heat exchange fluids operationally flows over said heat exchanger tubes in a radially outward direction with respect to the longitudinal axis of said arrays.

7. A heat exchanger as claimed in claim 1 wherein said third manifold is in flow communication with supply and exhaust pipes for said second fluid, which are themselves in flow communication with said first and second manifolds, via a bifurcated pipe, said valve means being provided in both of said bifurcated portions of said bifurcated pipe and additionally in that portion of said pipe for said second fluid which extends between said bifurcated pipe and said first manifold.

8. A heat exchanger as claimed in claim 1 wherein said first fluid is gaseous air and said second fluid is cold hydrogen.

* * * * *